US006131823A

United States Patent [19]

Langeman

[11] Patent Number: 6,131,823

[45] Date of Patent: Oct. 17, 2000

[54] LOW PRESSURE DISPENSING GUN

[76] Inventor: Gary D. Langeman, 389 East County Road 31 R.R. 2, Ruthven, Ontario, Canada, N0P 2G0

[21] Appl. No.: 09/192,992

[22] Filed: Nov. 16, 1998

[30] Foreign Application Priority Data

Jan. 14, 1998 [CA] Canada ..... 2226936

[51] Int. Cl.[7] ..... B05B 1/28

[52] U.S. Cl. ..... 239/291; 239/419.3; 239/423

[58] Field of Search ..... 239/290, 291, 239/398, 418, 419, 419.3, 422, 423, 424, 427, 427.3, 427.5, 428, 525, 526

[56] References Cited

U.S. PATENT DOCUMENTS

| | | | |
|---|---|---|---|
| 2,276,237 | 3/1942 | Lowry et al. | 259/151 |
| 3,164,377 | 1/1965 | Cramer, Jr. | 259/7 |
| 3,610,536 | 10/1971 | Pease et al. | 239/419.3 X |
| 3,949,904 | 4/1976 | Hendrickson | 222/135 |
| 3,984,001 | 10/1976 | Nagano et al. | 209/3 |
| 4,098,515 | 7/1978 | Sakata | 277/165 |
| 4,133,542 | 1/1979 | Janian et al. | 277/152 |
| 4,460,278 | 7/1984 | Matsubara et al. | 366/149 |
| 4,508,356 | 4/1985 | Janian | 277/205 |
| 4,767,025 | 8/1988 | Gebauer et al. | 222/135 |
| 4,798,190 | 1/1989 | Vaznaian et al. | 239/423 X |
| 4,881,821 | 11/1989 | Stutz | 366/162 |
| 5,072,883 | 12/1991 | Vidusek | 239/290 |
| 5,163,692 | 11/1992 | Schofield et al. | 277/153 |
| 5,405,083 | 4/1995 | Moses | 239/428 X |
| 5,810,254 | 9/1998 | Kropfield | 239/526 X |

*Primary Examiner*—Andres Kashnikow
*Assistant Examiner*—Sean P. O'Hanlon
*Attorney, Agent, or Firm*—Nields & Lemack

[57] ABSTRACT

A dispensing gun for atomizing a fluid under pressure with pressurized air includes a body having two fluid inlet structures and an air inlet structure defined in the body. An elongate barrel housing projects outwardly from the body. A longitudinal air passageway communicating with the air inlet structure, and a longitudinal fluid passageway communicating with the fluid inlet structure are defined within the barrel housing. An atomizing structure for atomizing the fluid under pressure with the air under pressure is connected to the distal end of the barrel housing.

22 Claims, 4 Drawing Sheets

LOW PRESSURE DISPENSING GUN

BACKGROUND OF THE INVENTION

1. Field of the Invention

This invention relates to a device for applying coating materials, such as, for example, paints, epoxies, polymers, and the like. In particular, the invention relates to a dispensing device or gun for application of liquid materials which must be atomized and delivered in a spray pattern.

The invention is particularly suited for applications which require the liquid coating material to be dispensed and applied evenly, and where merely pouring the liquid compound onto the contact surface does not produce the desired result. In this case, atomization of the fluid stream in order to produce a spray pattern is commonly required.

Atomization of a fluid can be achieved either by pumping the fluid through an orifice at high pressure using an apparatus specifically designed to create atomization, or, alternatively, by air atomization.

2. Description of the Prior Art

Air atomization is a known process, where, as the stream of fluid under low pressure exits the dispensing device, the fluid stream is enveloped by pressurized air delivered to the fluid exit point to form droplets in a defined pattern. It is known in the prior art to attach an air nozzle assembly to the exit point of a delivery tube of a dispensing device in order to achieve air atomization. There are a number of known designs for the air nozzle assembly and for the means of attaching it to the fluid exit point of a dispensing device.

Prior art devices typically deliver the pressurized air to the air nozzle assembly through an air conduit in the form of a flexible hose or tube positioned externally along the entire length of the delivery tube of the dispensing device. The air conduit typically terminates at the air nozzle assembly. Accordingly, the entire apparatus takes up a large amount of space, making the dispensing device cumbersome, awkward to disassemble, and difficult to operate in tight spaces, such as inside a small mold cavity, or in crevices.

SUMMARY OF THE INVENTION

It is an object of the invention to provide an improved dispensing gun which, by requiring fewer parts to assemble, is more cost-effective to manufacture, and allows for decreased maintenance time requirements. In addition, the dispensing gun provides the operator with an ergonomic, easy to use dispensing tool which can be comfortably used in confined spaces previously difficult to access using existing dispensing devices.

For convenience, the description of the preferred embodiment of the invention refers to a dispensing gun which is adapted to receive and mix two liquid components, such as, for example isocyanate and polyol, within the dispensing gun and then atomize the mixture to form an even polyurethane coating. However, it will be understood by those skilled in the art that the dispensing gun can be manufactured to deliver a single fluid or more than two fluids, with or without a mixing structure, and such variations are within the scope of this invention.

In the invention, a dispensing gun has a body having preferably two fluid inlet structures and an air inlet structure defined therein. An elongate barrel housing projects outwardly from the body. A longitudinal air passageway communicating with the air inlet structure and a longitudinal fluid passageway communicating with the fluid inlet structure are defined within the barrel housing. An atomizing structure for atomizing the fluid under pressure with the air under pressure is connected to the distal end of the barrel housing.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DESCRIPTION OF THE PREFERRED EMBODIMENT

Figure 1:
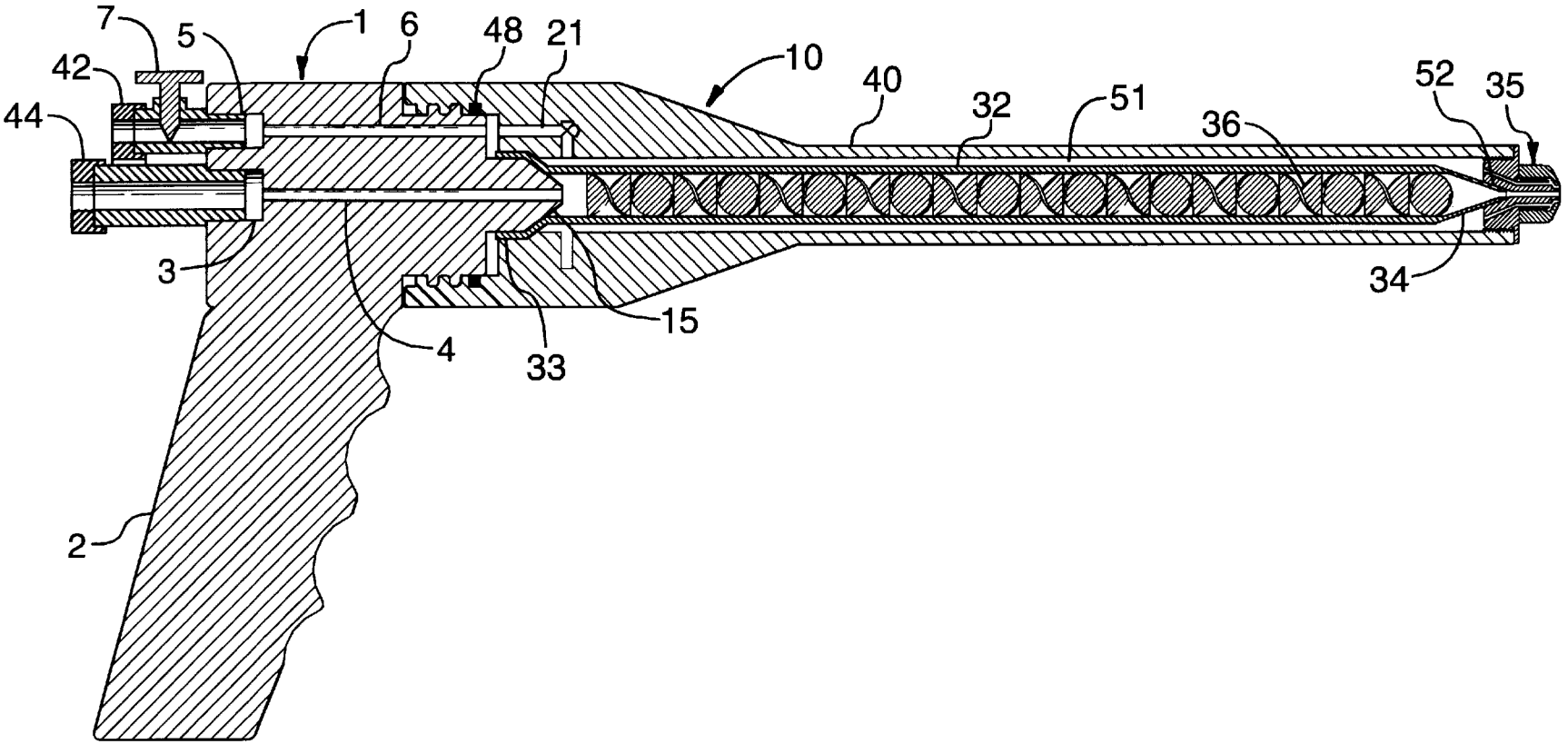
FIG. 1 is a cross-sectional view of a preferred embodiment of the invention.
Figure 2:
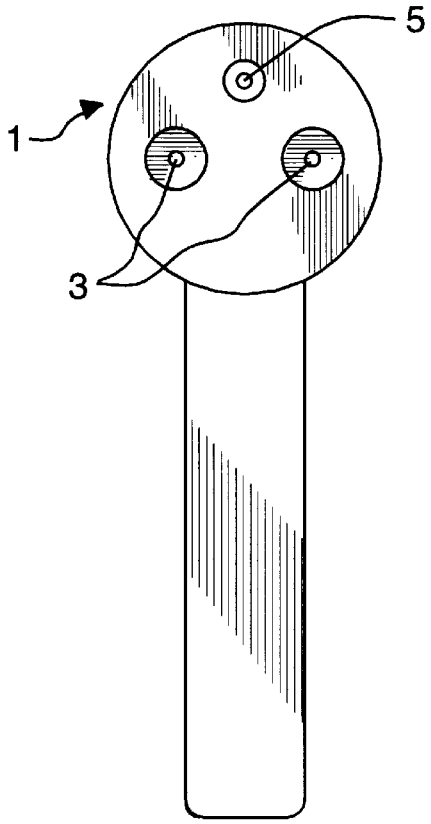
FIG. 2 is a rear elevation view of the preferred embodiment.
Figure 3:
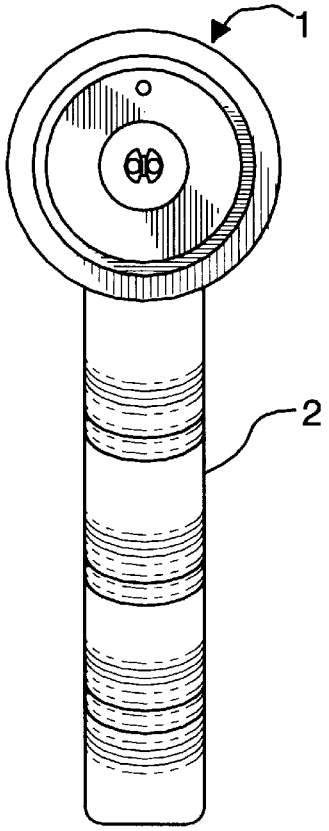
FIG. 3 is a front elevation view of the preferred embodiment.
Figure 5:
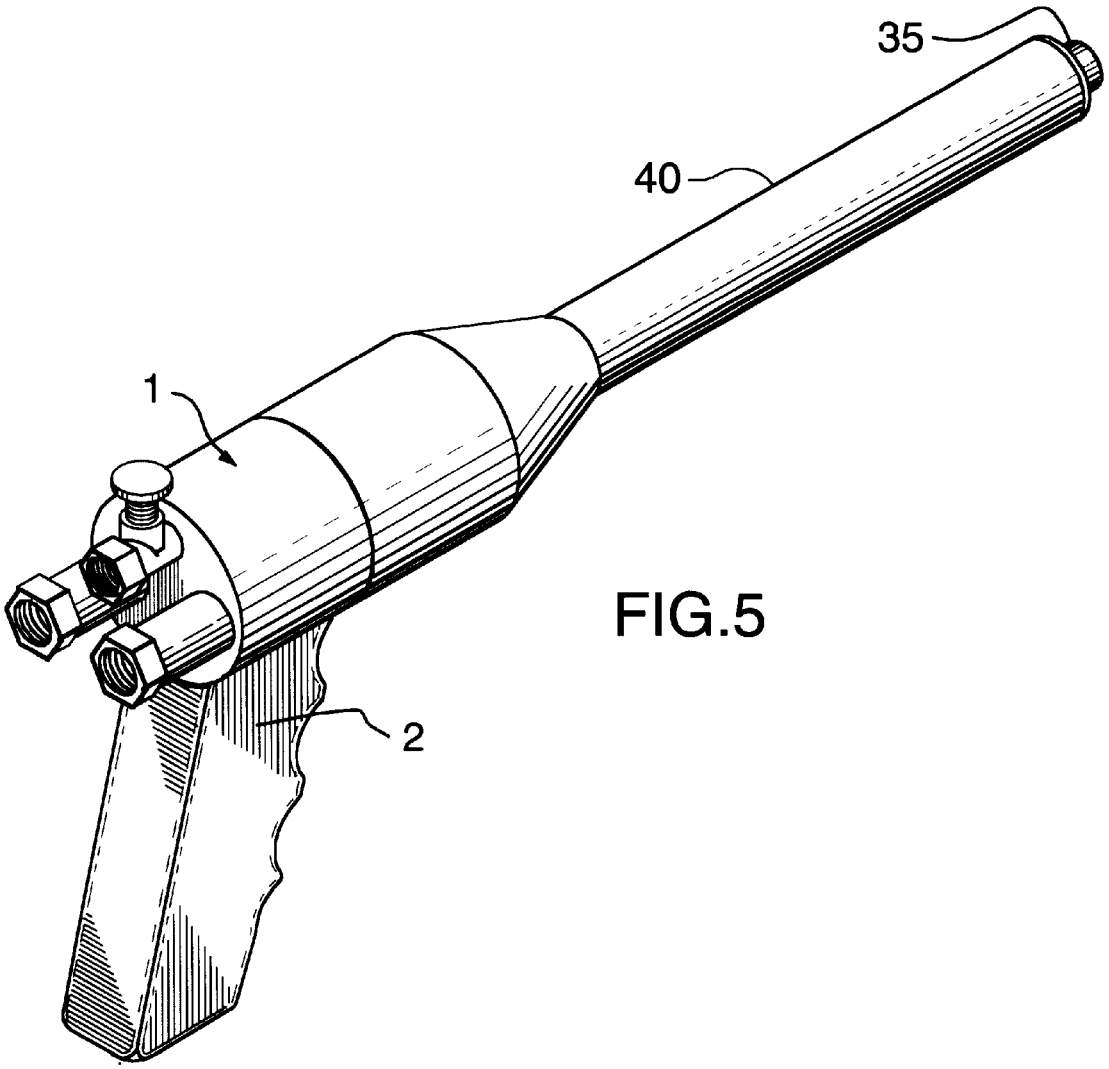
FIG. 5 is a perspective view of the preferred embodiment.

FIGS. 1 and 5 show a preferably cylindrical body 1 of the dispensing gun with a preferably integral handle portion 2 projecting downwardly from the body. The body and handle are manufactured from any suitable material, such as, for example, aluminium. Preferably, two fluid inlet structures, such as conventional pressurized fluid material inlet ports 44, are sealably secured within corresponding openings 3 within the rear portion of the body. The inlet ports are secured in any suitable fashion, such as, for example by threadably engaging a corresponding threaded portion of the openings. Preferably, one fluid inlet port is connected to a supply of isocyanate and the other to a supply of polyol, which are mixed within the gun in order to form a reactive mixture. The fluids to be mixed are delivered to the inlet ports by conventional pumps (not shown) and the pressure is regulated by any known means, such as, for example, computer controls (not shown). The fluid material inlet ports are in fluid communication with corresponding fluid inlet channels 4, which run through the body, exiting at a front "nose" section 15 adapted to sealably engage a fluid delivery tube 32 described in detail below.

An air inlet structure, such as a needle valve assembly 42, is secured within a corresponding recess 5 within the rear portion of the body and is in fluid communication with an air inlet channel 6 also running through the body generally parallel to the fluid inlet channels. The flow of the pressurized air is regulated by any suitable means, such as a thumb screw 7.

Figure 4:
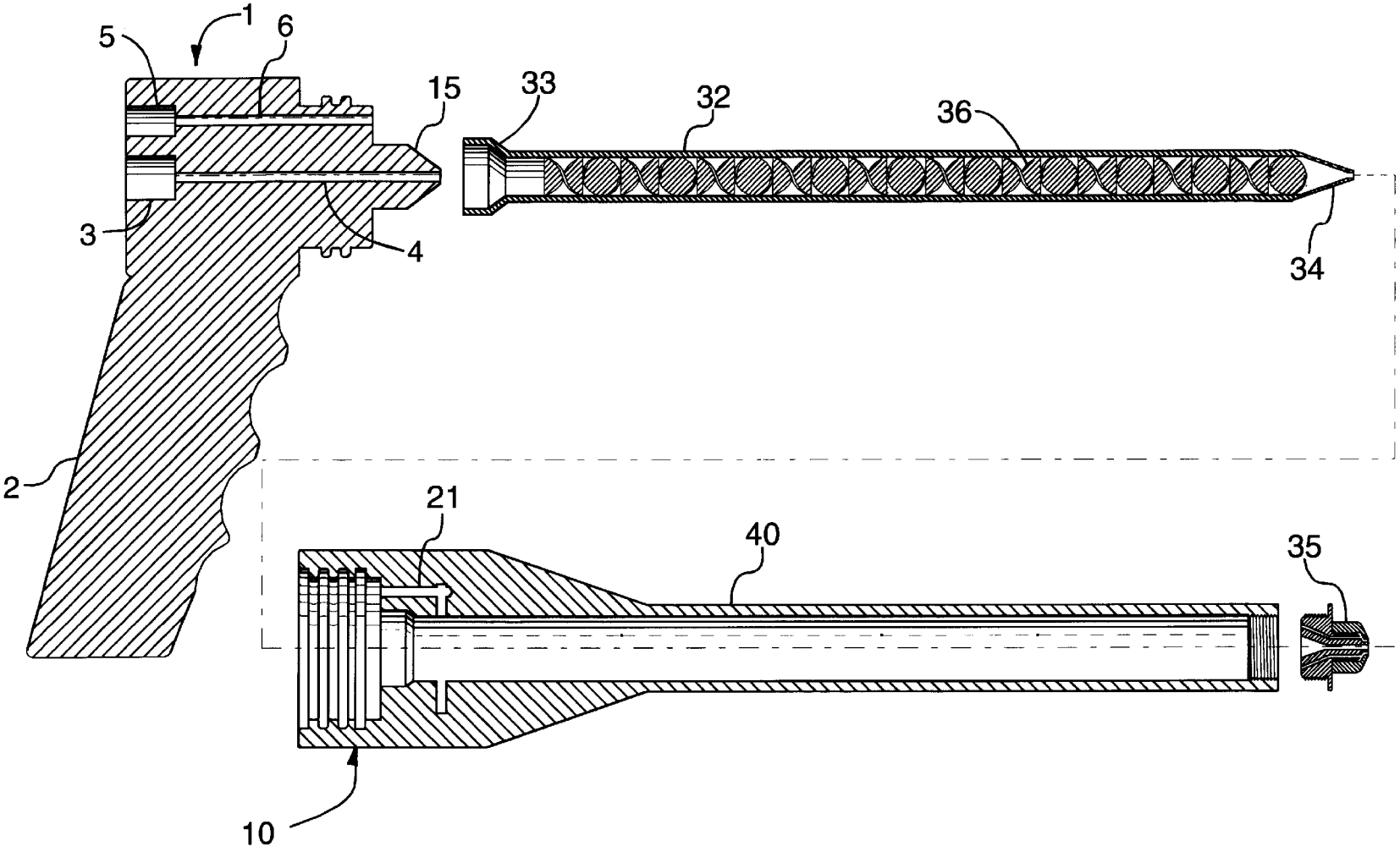
FIG. 4 is an exploded cross-sectional view of the preferred embodiment.

FIGS. 1, 4, and 5 show a preferably generally cylindrical aluminium barrel assembly 10 projecting outwardly from the body 1. Preferably, the outer sleeve 40 of the barrel is threadably secured to the body, and the connection is sealed by an O-ring 48. A preferably plastic generally cylindrical fluid delivery tube 32 is nested within the sleeve. The interior of the tube defines a longitudinal fluid passageway. When the sleeve is threadably secured to the body, a bell-shaped first end 33 of the tube is pressed against the "nose" section 15 of the body, such that a seal is established between the body and the tube. The fluid inlet channels 4 are then also in fluid communication with the delivery tube. A second tapered end 34 of the delivery tube is adapted to sealably engage a corresponding inner bore 52 of a conventional atomization air nozzle assembly 35. Preferably, a mixing structure, such as a conventional removable plastic mixing element 36 of a spiral or helical configuration, is disposed along the length of the fluid delivery tube. The mixing element is slightly shorter than the tube and is secured within the tube by an interference fit. The shape of the mixing element can be varied depending on the fluids to be mixed and the type of mixing required.

An air channel 21 is machined within the barrel assembly 10 such that when the barrel is threadably secured to the body 1, the air channel aligns and is in fluid communication with the air inlet channel 6. The air channel 21 is also in fluid communication with a longitudinal air passageway defined within the barrel assembly. The longitudinal passageway is preferably a circular air conduit 51 defined by the outer surface of the fluid delivery tube 32 and the inner surface of the sleeve 40.

An atomizing structure, such as an atomization air nozzle assembly 35, is then sealably secured to the distal end of the barrel assembly 10 where the pressurized air and the fluid mixture stream exit the dispensing gun. The air nozzle is secured to the barrel assembly in any suitable fashion, such as threadably engaging a corresponding threaded portion of the inner surface of the outer sleeve 40.

During operation, the two fluids to be mixed are generally delivered under pressure of less than 200 PSI to the corresponding fluid inlet ports 44. The fluids travel through the body 1 via the fluid inlet channels 4, and enter the fluid delivery tube 32. The fluids are mixed by the mixing element 36, which continually divides and recombines the fluids in the delivery tube to achieve thorough mixing. The relative concentrations of the two fluids can be adjusted to achieve an appropriate chemical reaction. Adjustments to the mixture may be made by a number of known means, such as manually altering the flow of each fluid from its pump or by using computer controls.

The pressurized air is delivered to the needle valve assembly 42 by a conventional air compressor. The air pressure can vary anywhere from 25 PSI to 125 PSI. The flow of the pressurized air is preferably adjusted by a thumb screw 7. The air travels through the air inlet channel 6, into the air channel 21 of the barrel 10, into and through the air conduit 51, and into the atomization air nozzle assembly 35.

The fluid mixture enters the atomization air assembly as a single stream. The atomization air nozzle assembly then envelopes the fluid stream with the pressurized air to form droplets which are dispersed in a pre-defined pattern. The spray pattern can be adjusted by restricting the air flow using the set screw 7, by adjusting the air pressure at its source, or by using air nozzles with varying configurations for the fluid and/or air orifices.

The dispensing gun according to the invention provides the user with an ergonomic, easy to use dispensing tool which can easily be used in confined spaces, previously difficult to access using prior art devices. Another major advantage of the invention is that the disposable fluid delivery tube can be removed without disconnecting an external air supply conduit, as required in prior art devices. Finally, the dispensing gun according to the present invention requires fewer parts to assemble resulting in a simpler device and decreased maintenance time requirements.

It will be appreciated that the above description relates to the preferred embodiment by way of example only. Many variations on the invention will be obvious to those knowledgeable in the field, and such obvious variations are within the scope of the invention as described and claimed, whether or not expressly described.

I claim:

1. A dispensing gun for atomizing a fluid under pressure with air under pressure, the gun comprising:

(a) a body defining:

(i) at least one fluid inlet structure formed therein; and (ii) an air inlet structure formed therein;

(b) an elongate barrel housing having a first end connected to said body and a second end, said barrel defining:

(i) a longitudinal fluid passageway communicating with said at least one fluid inlet structure; and (ii) a longitudinal atomizing air passageway communicating with said air inlet structure; and (c) an atomizing structure for atomizing said fluid from said fluid passageway with said air under pressure from said atomizing air passageway, said atomizing structure being coupled to said second end of said barrel.

2. A dispensing gun as defined in claim 1, wherein said gun further comprises a handle portion projecting downwardly from said body.

3. A dispensing gun as defined in claim 2, wherein said handle portion is integrally molded to said body.

4. A dispensing gun as defined in claim 1, wherein said barrel housing further comprises:

(a) a sleeve having an inner surface and an outer surface;

(b) a fluid delivery tube nested within said sleeve, said tube having an outer surface, said tube being said longitudinal fluid passageway;

said inner surface of said sleeve and said outer surface of said tube defining an air conduit, said air conduit being said air passageway.

5. A dispensing gun as defined in claim 4, wherein said barrel housing is sealably connected to said body.

6. A dispensing gun as defined in claim 4, wherein said tube is sealably connected to said body.

7. A dispensing gun as defined in claim 6, wherein said fluid delivery tube further comprises a mixing structure located within said fluid delivery tube.

8. A dispensing gun as defined in claim 7, wherein said fluid delivery tube is removable from said sleeve for disposal.

9. A dispensing gun as defined in claim 8, wherein said mixing structure is removable from said tube for disposal.

10. A dispensing gun as defined in claim 4, wherein said fluid delivery tube is removable from said sleeve for disposal.

11. A dispensing gun as defined in claim 1, wherein said body defines said atomizing air passageway.

12. A dispensing gun as defined in claim 1, wherein said body integrally defines said atomizing air passageway.

13. A dispensing gun for atomizing a fluid under pressure with air under pressure, said gun comprising:

(a) a body having:

(i) at least one fluid inlet structure defined therein; and (ii) an air inlet structure defined therein;

(b) an elongate barrel housing having a first end connected to the body and a second end, said barrel comprising:

(i) an outer sleeve; and (ii) an elongate fluid delivery tube nested within said sleeve, said fluid delivery tube being in communication with said at least one fluid inlet structure, said fluid delivery tube and said sleeve defining an atomizing air conduit therebetween, said atomizing air conduit being in communication with said air inlet structure;

(c) an atomizing structure for atomizing said fluid from said fluid delivery tube with said air under pressure from said atomizing air conduit, said atomizing structure being connected to said second end of said barrel.

14. A dispensing gun as defined in claim 13, wherein said gun further comprises a handle portion projecting downwardly from said body.

15. A dispensing gun as defined in claim 14, wherein said handle portion is integrally molded to said body.

16. A dispensing gun as defined in claim 13, wherein said barrel housing is sealably connected to said body.

17. A dispensing gun as defined in claim 16, wherein said fluid delivery tube further comprises a mixing structure located within said fluid delivery tube.

18. A dispensing gun as defined in claim 17, wherein said fluid delivery tube and said mixing structure are removable from said sleeve for disposal.

19. A dispensing gun as defined in claim 18, wherein said fluid delivery tube is sealably connected to said body.

20. A dispensing gun as defined in claim 13, wherein said fluid delivery tube is removable from said sleeve for disposal.

21. A dispensing gun as defined in claim 13, wherein said body defines said atomizing air conduit.

22. A dispensing gun as defined in claim 13, wherein said body integrally defines said atomizing air conduit.

* * * * *